US005403125A

United States Patent [19]

Andersen

[11] Patent Number: 5,403,125

[45] Date of Patent: Apr. 4, 1995

[54] METHOD AND APPARATUS FOR PROVIDING UNDERGROUND BARRIER

[75] Inventor: Scott Andersen, Lake Oswego, Oreg.

[73] Assignee: Constructors Engineering Co., Inc., Lake Oswego, Oreg.

[21] Appl. No.: 143,825

[22] Filed: Oct. 27, 1993

[51] Int. Cl.[6] ..... E02D 5/20

[52] U.S. Cl. ..... 405/267; 405/109; 405/269

[58] Field of Search ..... 405/109, 116, 117, 176, 405/240, 241, 267, 269, 270

[56] References Cited

U.S. PATENT DOCUMENTS

| | | | |
|---|---|---|---|
| 4,927,297 | 5/1990 | Simpson | 405/267 X |
| 5,141,364 | 8/1992 | Degen et al. | 405/240 |
| 5,246,312 | 9/1993 | Taki | 405/267 |
| 5,320,454 | 6/1994 | Walling | 405/267 |

*Primary Examiner*—David H. Corbin
*Attorney, Agent, or Firm*—Robert L. Harrington

[57] ABSTRACT

An apparatus, method and system for installing water impervious barrier walls underground and particularly in levees. A mobile trailer movably mounted on rails carries upstanding front and rear masts and a carrier bar therebetween that is power driven up and down the masts. Augers mounted on the carrier bar are driven into the levee surface to create overlapping holes of loosened soil. A slurry of cement based grout is pumped through the augers to be mixed with the soil by the rotating, retracting augers to produce a soil-concrete slurry. A following mobile trailer also movably mounted on the rails is moved into position over the wall segment of uncured soil-concrete slurry. The following trailer carries a supply of water impervious membrane. Mechanism on the second trailer inserts the membrane into the soil-concrete slurry to produce a water impervious barrier wall segment. The trailers are sequentially moved along the levee to install a continuous water impervious barrier wall along the levee length.

13 Claims, 7 Drawing Sheets

METHOD AND APPARATUS FOR PROVIDING UNDERGROUND BARRIER

FIELD OF THE INVENTION

This invention relates to the installation of concrete walls underground to provide a barrier, e.g., to impede the flow of water, and more particularly to the installation of concrete walls without having to excavate prior to installation.

BACKGROUND OF THE INVENTION

The concept of installing a concrete wall without prior excavation is not new to this invention. Foundations for large office buildings have been installed using a method whereby an auger manipulated by a large crane, drills down into the ground to a desired depth, e.g., 20 feet to create a hole of loosened soil. The auger has a hollow shaft and a cement based grout is pumped through the shaft to the auger head. As the auger is withdrawn, the auger blades mix the grout and the soil to produce soil-concrete. This produces a concrete column or post and similar columns or posts are formed side by side to produce a continuous wall.

The concept generally described avoids the necessity of having to excavate huge quantities of dirt in order to install a foundation or footing. It is particularly applicable to areas having sandy soil. Sand is a good material for producing concrete and it is difficult to excavate because the sides surrounding the cavity will cave into the cavity.

This concept has potential application for structures other than building foundations. One application is for producing trenches for laying pipe and is applicable especially where sandy soil conditions are encountered. Thus, parallel concrete walls are installed in the ground at each side of the proposed trench and the soil between the walls is thereafter removed. The concrete walls will prevent the soil from caving into the trench so that a pipe can be laid.

More recently there has been an increased appreciation for providing barriers in earth levees. Rivers offer many advantages to communities. They provide electricity, drinking water, irrigation water, attractive environment and recreation to name a few. However, every so often Mother Nature produces a combination of conditions that cause the rivers to overflow reeking havoc to these riverside communities. The damage caused by flooding can be somewhat controlled with levees. In those areas where a rising river would normally overflow its banks and cause significant damage, earth levees are provided along the river bank to confine the water flow to the banks. These levees can extend for a hundred miles or more. The requirement for massive volumes of material to create a levee renders it desirable to use the surrounding soil to construct the levees.

The surrounding soil is typically sandy and quite pervious to water. A soil-only levee will withstand short durations of flooding but experience has taught that prolonged flooding conditions will saturate the soil leading to erosion and destruction of the levee. The provision of an impervious barrier down the middle of the levee is desirable.

The concept of providing a concrete wall barrier along a levee using the above-described auger filling process is attractive but presents numerous problems. To name a few, the equipment used to install foundations is too heavy and not sufficiently mobile; concrete is not normally impervious to water without special treatment which adds undesired cost; preparation of the cement based grout on site provides problems. Solutions to these and numerous other problems that are encountered in adapting the auger filling process for producing elongated underground barrier walls is the primary objective of the present invention.

BRIEF SUMMARY OF THE INVENTION

The preferred embodiment of the present invention is directed to emplacement of a barrier wall in a levee. The apparatus employed includes a mobile chassis supporting an upstanding support frame. A vertical sliding carriage or carrier bar is supported by the frame and vertical sliding movement of the carriage is controlled by a chain drive. Multiple augers, e.g., 30 auger shafts each carrying an auger head are mounted to the carriage to span a lateral distance of about 25 feet. That is, the multiple side-by-side augers will produce, with each drilling cycle, a wall segment of about 25 feet. The auger shafts are hollow and connected to a liquid conveyor line or hose. Separate motors mounted to the augers rotatably drive the augers. Rails are extended along the intended path of the barrier wall and the chassis is supported for movement along the rails. Hydraulic power units mounted on the chassis provide hydraulic pressure to drive the motors for the chain drive and auger rotation.

A second chassis carries an upstanding frame and also includes a vertical sliding carriage or carrier bar that is chain driven. Rolls of pliable water-impervious membrane are mounted to the second chassis. The leading edge of the membrane is formed into a sleeve and a length of rigid rod, e.g., rebar is inserted into the sleeve. Pusher rods are mounted between the carriage and the rigid rod. The second chassis also carries a reel of conveyor hose and a grout mixing tank. The liquid conveyor line for the augers is connected to the grout mixing tank for pumping grout through the hollow cores of the auger shafts and into the holes formed by the augers.

In operation, the rails are placed along the levee top and the two chassis are placed on the rails. The augers carried by the carriage of the first chassis are driven down through the levee with the auger shafts being rotated. Water is pumped through the conveyor line into the hollow shaft and out through the auger head to lubricate and moisten the soil that has been loosened by the augers. When the desired depth is achieved, grout is pumped from the mixing tanks of the second chassis through the conveyor line and into the hollow shaft of the augers. The grout is mixed with the loosened dirt as the augers are withdrawn and thereby produces an soil-concrete slurry that fills the hole.

The second chassis replaces the first chassis over that wall section and lowering the carriage causes the pusher rods to push the pusher rods and the rigid rod to which it is connected into the slurry. The rigid rod being confined in the sleeve formed in the leading edge of the membrane thus pulls a length of membrane down through the slurry.

There are numerous additional features. A notable one is the use of a foaming agent that expands the grout and in effect doubles the volume of the grout. It is even more pervious to water but the membrane provides the water barrier and the concrete functions as an anchor for the membrane. The cellular grout dramatically lowers the cost of installing the barrier wall and the lower density renders the slurry more easy to insert the membrane.

Movement of the chassis is accomplished by simply rolling the chassis along the rails. The rails offer the benefit of less frictional resistance to rolling and spreads the weight of the equipment over a substantial length of the rails. The invention further encompasses a procedure whereby limited length of the rails, e.g., a couple of hundred feet, can be moved along the levee following installation of a corresponding length of the wall so as to avoid having to lay out a full length of permanent track.

The many features of the invention will be more fully appreciated upon reference to the following detailed descriptions and drawings that follows.

DESCRIPTION OF THE DRAWINGS

The sequence of drawings indicated as FIGS. 1A–1D illustrate the prior art process in present use, e.g., for installing foundations for large buildings. FIG. 1A represents an auger 10 which includes a hollow shaft 12 having digging flights 14 and beater bars 16 provided on the leading head portion only of the shaft 12. FIG. 1A represents the digging phase of the operation wherein the shaft 12 is rotated, e.g., by a motor 18 and interconnecting gears 20, 22 while the auger is being driven into the ground indicated by arrow 30. Whereas the auger flights of the head portion dig and thereby loosen the soil, the loosened soil 28 remains in the hole.

FIG. 1B represents the filling phase of the operation wherein the shaft 12 is withdrawn from the hole as indicated by arrow 32, as a grout 26 through line 24 is directed through the hollow shaft 12 and into the loosened soil 28. The flights 14 and beater bars 16 intermix the grout 26 and loosened soil 28 to produce a soil-concrete mix 34.

FIG. 1D illustrates the manipulation of a plurality of augers, e.g., four in number, by a crane 36 to sequentially drill and fill holes in overlapping side-by-side relation to produce a foundation wall 38. FIG. 1C illustrates a top plan view of a segment of the wall 38 wherein the overlapping auger holes produce a wall thickness indicated by the dash lines 40.

FIG. 2 schematically illustrates one embodiment of the present invention. As briefly explained in the background of the invention, the present invention has particular application for providing a water impervious barrier in a levee. In FIG. 2, a levee 42 has been erected along the bank of a river 44. The levee is constructed of earth or soil and is preferably comprised primarily of sand. The objective of the invention is to embed into the levee an endless membrane barrier 46 that is impervious to water and, thus, prevents water from seeping through the porous earth and into the dry side of the levee. Various machines and apparatus are used to accomplish this objective and the process involved and apparatus utilized therefor will be generally described with reference to FIG. 2. The specific apparatus of each machine will be explained in detail in later sections.

Figure 1A:
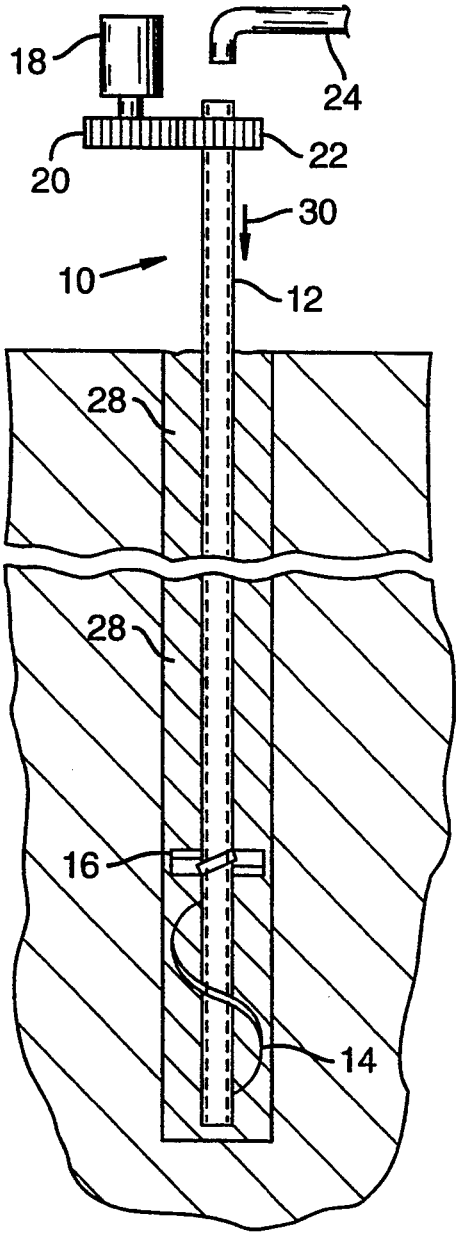
FIG. 1A PRIOR ART
FIGS. 1A, 1B, 1C and 1D illustrate the prior art.

Positioned on top of the levee 42 is a tractor 48, a post inserting trailer 50 and a membrane inserting trailer 52. Positioned on the dry side of the levee on a road 54 is a mobile grout mixing plant 56. The grout mixing plant 56 is basically a mixer 58 that mixes a desired quantity of dry cement, e.g., from a truck 60 conveyed to the mixer through a conveyor 62, and a desired quantity of water, e.g, from the river 44 and conveyed through a hose 64. This mixture of water and cement will hereafter be referred to as grout.

The grout is, e.g., poured from the mixer 58 into a tank 66 and pumped through a hose 68 to the membrane inserting trailer 52 which carries a hose reel 70. The hose reel 70, having, e.g., a mile long length of hose rolled onto the reel, allows the hose 68 to be extended along the levee length as the apparatus is moved from wall segment to wall segment as will be explained. The grout is forced through a connecting hose 72 that connects a holding tank 74 to the hose reel 70, e.g., through a swivel connection 76.

Figure 1B:
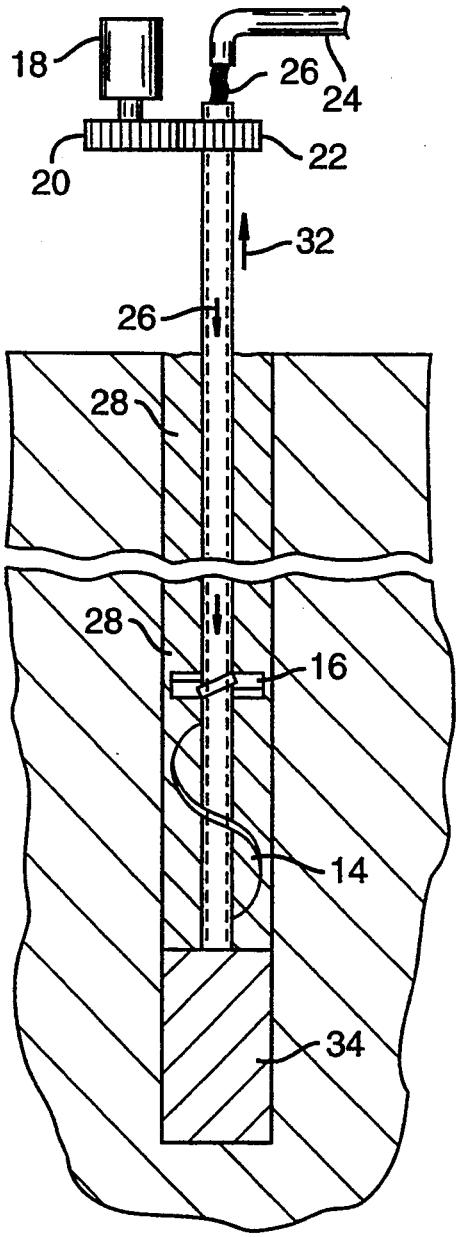
FIG. 1B PRIOR ART

A secondary mixer 78 receives grout from the holding tank 74 and mixes it with a foaming agent from bladder 136. The grout and foaming agent mixture is referred to as cellular grout. The cellular grout is pumped from the secondary mixer 78 through a hose 80 to augers 82 mounted on the post inserting trailer 50. The augers 82 are similar in construction to the augers of FIGS. 1A and 1B and the hose 80 functions similar to the hose 24 of FIGS. 1A and 1B. However, water is initially pumped through the auger shafts in a digging mode (the water, e.g., being pumped from river 44 through a hose 84) to saturate the loosened soil and to aid the hydration and curing of the cellular soil-concrete. The cellular grout is pumped through the hose 80 as the augers are withdrawn and in the soil-concrete mixing mode as described for FIG. 1B.

It will thus be understood that cellular soil-concrete posts are inserted into the levee by the process of (a) the augers 82 are driven into the levee (by mechanism that will be later explained) and water is pumped through the hose 84 into the hollow core of the augers; (b) as the augers are drilling the holes, cellular grout is being mixed in secondary mixer 78, grout is being pumped into holding tank 74 from tank 66, and cement and water are being mixed into grout in mixer 58; (c) with the holes now filled with loosened earth, preferably sand, the augers are controllably withdrawn from the holes but still turning the augers, and cellular grout is concurrently pumped through hose 80 into the auger shaft cores from secondary mixing tank 78. During the process of auger withdrawal, the process of mixing grout continues and as soon as the secondary mixing tank 78 is emptied (upon full removal of the augers) the grout from tank 74 is released into the mixing tank 78 with a desired quantity of a foaming agent 136 (also carried by the trailer 52) to begin mixing a further batch of cellular grout. The valve between holding tank 74 and secondary mixer 78 is closed and grout from tank 66 continues to be pumped into the holding tank 74.

The above procedure encompasses a full cycle of the hole drilling/filling process. The next step is to move the assembly of trailers 50, 52 along the levee to the next 25 foot segment. Such movement can be readily accomplished due to the entire assembly being mounted on tracks 86. Both trailers 50, 52 are mounted on chassis having an undercarriage including wheels that are designed to be supported on the tracks 86. The tractor 48 which may or may not be supported on the tracks, is hitched to the trailers 50, 52 and they are simply pulled by the tractor along the levee on the rails to the next position.

The next step may simply be to drill the next series of holes, it may be to insert the membrane 46 or it may be to accomplish these operations simultaneously. As will be explained in more detail, there are preferably about thirty augers 82 carried by trailer 50 and they produce a wall segment of about 25 feet. It is believed desirable to coordinate the drilling/filling operation and the membrane inserting operation, i.e., to accomplish both operations simultaneously. However, the operation of the two procedures will be influenced by a number of factors. It is quite conceivable that the two trailers could be separated with a second tractor pulling trailer 52 and the operations conducted independently. It is important, however, that the membrane insertion operation be accomplished while the cellular soil-concrete is soft (uncured) and thus it is considered desirable to coordinate the two operations as suggested in FIG. 2 and as will be explained.

Consider that the length of the wall segment produced by one cycle of the augers is 25 feet. It is probably desirable that the length of membrane inserted by a single cycle of the membrane inserting trailer is also 25 feet. However, a possible alternative is to double the length of the trailer 52 and cycle the membrane insertion operation every other cycle of the augers. Experience with these two operations will dictate how the two operations are most efficiently coordinated.

In the further explanation, it will be assumed that the length of the wall segment created by trailer 50 is the same length as the length of membrane inserted into wall segment, e.g., 25 feet. Because the two operations cannot be abutted end to end, they are spaced apart by the same length of a wall segment, e.g., 25 feet. Thus, the procedure involves drilling holes and inserting earth-concrete mix in a first 25 foot segment designated A in FIG. 2 and allowing a prior wall segment B to sit idle while the next following segment designated C is receiving the membrane. The membrane inserting procedure will now be briefly explained.

Figure 2:
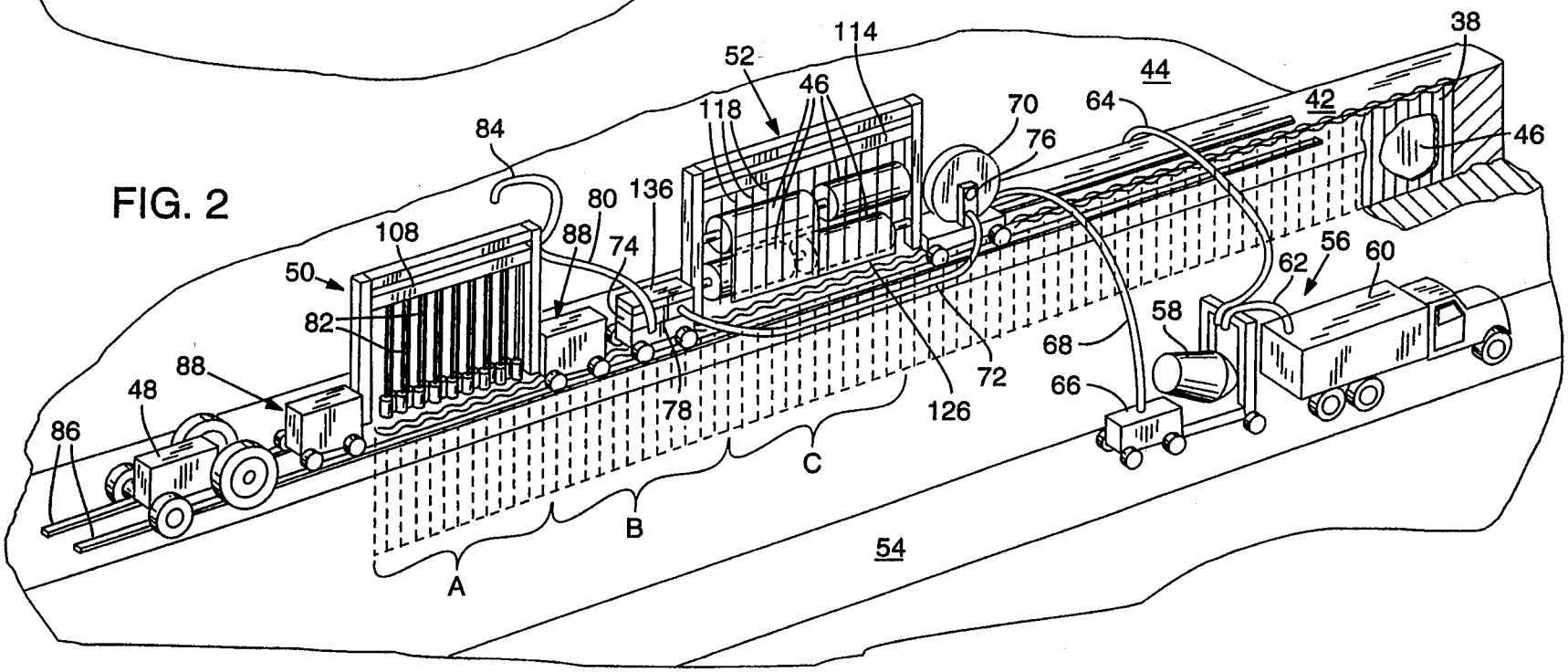
FIG. 2 is a schematic view of the process and various apparatus of the present invention.

As shown in FIG. 2, four rolls of a water impervious membrane 46, e.g., thin flexible sheets of polyvinyl chloride (PVC) are mounted on the trailer 52. Only two of the rolls will be in use at one time, i.e., one top and one bottom roll. When these rolls are emptied, the alternate rolls are brought into service. The combined width of the side-by-side rolls will be 25 feet unless a double length of membrane is being installed in which case the combined length will be 50 feet. (Alternately a single 25 foot roll may be used.)

Figure 4A:
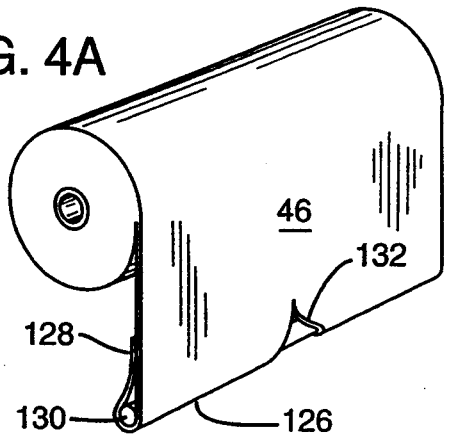
FIG. 4A illustrates a wall of membrane ready for insertion by the apparatus of FIG. 4.

In operation, the leading edge of the membrane 46 off the side-by-side rolls is doubled over and welded together to form a loop or sleeve along the leading edge 126 (see FIG. 4A). A length of rigid crossbar, e.g., rebar is inserted through the sleeve. An overhead carrier bar 114 is fitted with rigid pusher rods 118, e.g., rebar, that have a hooked lower end that interconnects with the crossbar. The overhead carriage is lowered, the pusher rods 118 thus force the leading edge 126 into the soft slurry comprising the wall segment C thus pulling a length of the membrane of the rolls and inserting it into the wall segment C. Upon reaching the desired depth, the pusher rods are either disconnected from the crossbar or from the overhead carriage (depending on whether it is desired to leave the rebar in the wall) and the carriage is raised. The membrane 46 is cut off along the top of the levee to form a new leading edge for the next membrane insertion cycle.

The last stage to be explained in the overall wall building operation is the track movement. Whereas it is not considered desirable to lay down a length of track 86 along the entire levee length (which may extend for 100 or more miles) the invention contemplates, e.g., a couple of hundred feet of track length to be periodically moved along the levee in a leap frog fashion. As will be explained in more detail hereafter, when the end of the track is reached by tailer 50 (assuming tractor 48 is not supported on the rails) hydraulic lifting jacks are engaged to lift the trailers 50 and 52 off the tracks. The tractor 48 is disconnected from the trailer 50 and connected to the end of the tracks (which ends may be provided with an appropriate hitch connection not shown). The tracks are then pulled along the levee top the appropriate length to locate the trailing end of the tracks under tailer 52. The tractor 48 is disconnected from the tracks 86, reconnected to the tractor 50, the trailers are lowered off the jacks and back onto the tracks and the tractor pulls the trailer along the levee to the next 25 foot segment.

The various apparatus will now be explained except for the mobile grout mixing plant 56. The components of the mixing plant 56 are schematically shown in FIG. 2 but are well known to the art and it is not necessary to explain them in detail. The other apparatus of the invention will be more fully explained under the separate headings "Post Inserting Trailer" and "Membrane Inserting Trailer".

Post Inserting Trailer

Figure 3:
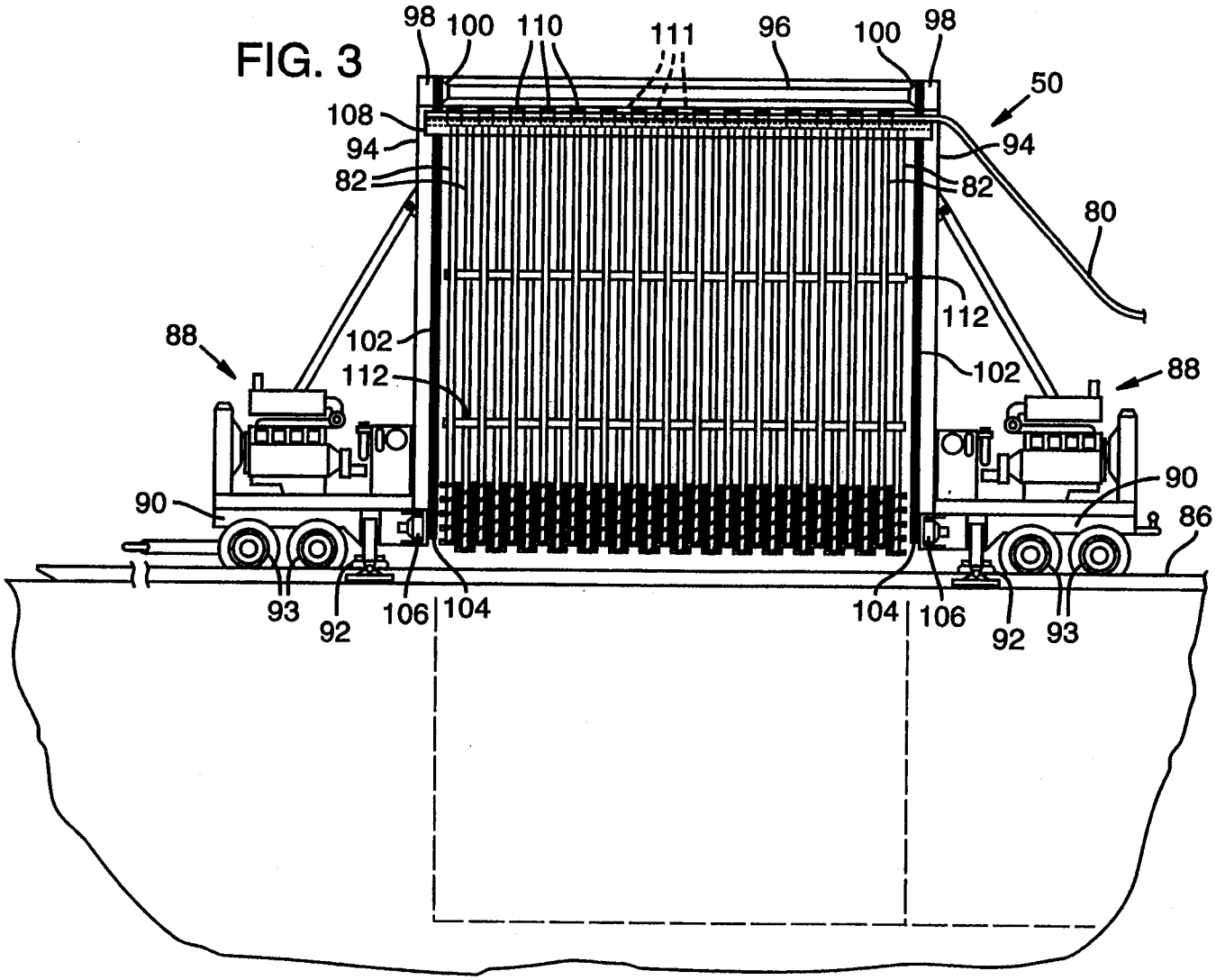
FIG. 3 illustrates the auger drilling apparatus of FIG. 2.

FIG. 3 illustrates the post inserting trailer 50. Mounted on each end of trailer 50 are hydraulic power units 88 which generate the hydraulic pressure for operating the hydraulic motors that drive the mechanism to be explained. These hydraulic power units include tanks, pumps, motors, valves and hoses which are well known to the art and much of which is deleted from this explanation and/or illustration for simplification.

As illustrated, the trailer 50 includes a supporting chassis 90 mounted on wheels 92 designed to ride on parallel tracks or rails 86 but also having tire portions 93 for transport of the trailers along a highway. FIG. 5 illustrates in detail the rail mounting apparatus for trailer 52 but it will be understood that the mounting apparatus for trailer 50 is similar.

Trailer 50 includes upstanding masts 94 which support the auger assembly. Extended between the masts 94 at the top thereof is a rotatable rod 96 supported on end bearings 98. The ends of the rod 96 (inward from bearings 98) carry sprockets 100 that support endless chains 102. Bottom sprockets 104 carried by hydraulic motors 106 support the lower end of the endless chain 102. (The sprocket 104 is substantially hidden by the chain 102 in this figure.)

Mounted to the chain 102 is a carrier crossbar 108 to which the augers 82 are rotatably mounted. Mounted to the top of alternating augers are hydraulic rotating motors 110. The augers not carrying a motor 110 are connected to the motors 110 through gears 111. Centralizers 112 maintain the spacing between the auger rods (bushings not shown permit rotation of the rods). The centralizers 112 are forced down through the loosened earth during the auger drilling operation.

Membrane Inserting Trailer

Figure 4:
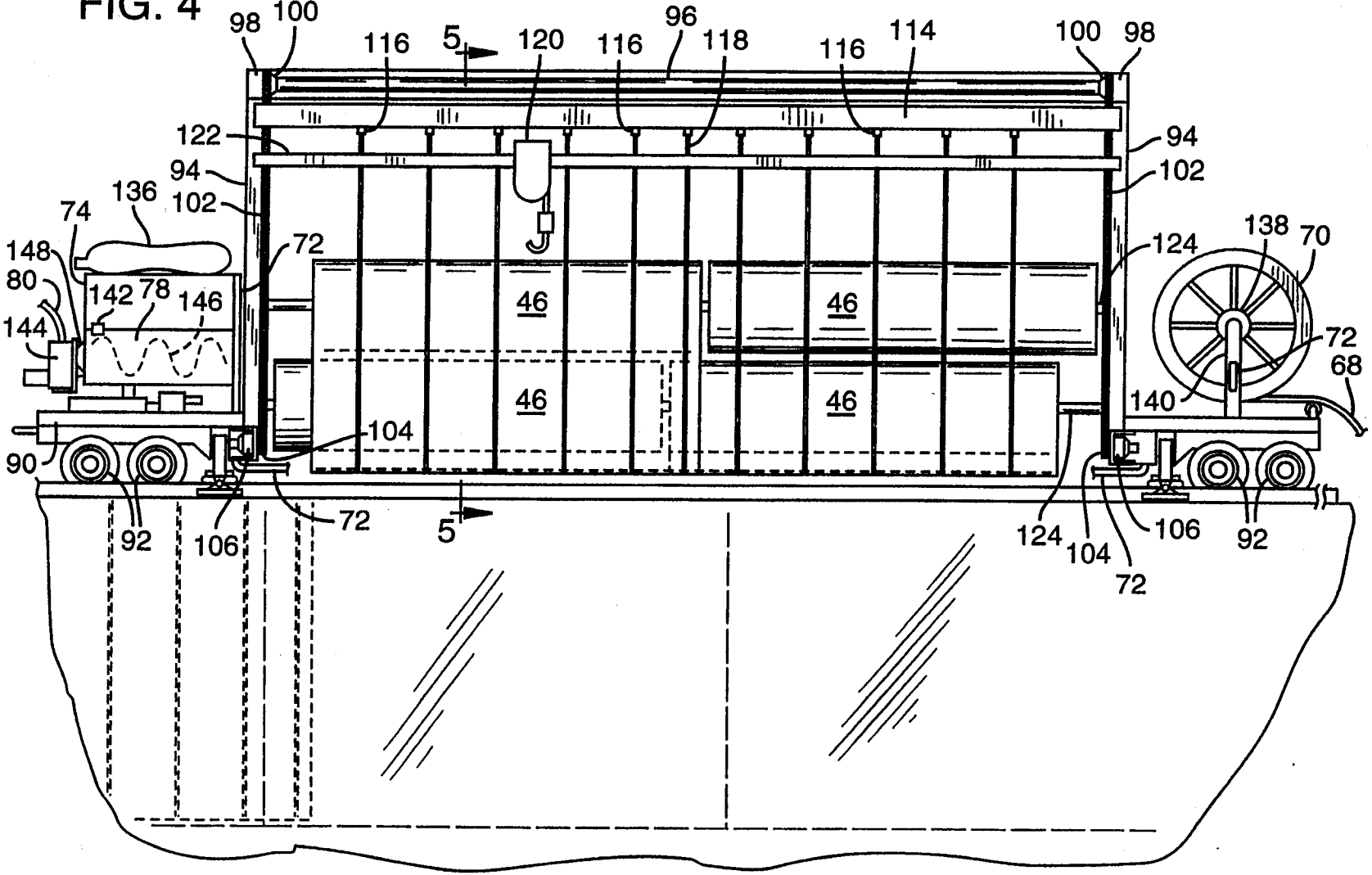
FIG. 4 illustrates the membrane inserting apparatus of FIG. 2.

The member inserting trailer 52 is illustrated in FIGS. 4 and 5. Much of the structure of the membrane inserting trailer is similar to the post inserting trailer 50. This includes the chassis 90, wheels 92, masts 94 and chain drive components 96, 98, 100, 102, 104 and 106. The chain drive components support a carrier bar 114 similar to carrier bar 108 of the post inserting trailer 50. The carrier bar 114 is provided with pipe-end-like holders 116 which are fitted with removable/replaceable pusher rods 118. A slidable winch 120 is provided on secondary support bar 122 to facilitate the handling of rods 118, i.e., for lifting them into position for insertion into holders 116.

Mounted between the masts 94 are rods 124 on which are mounted rolls of membrane 46. There are two top rolls and two bottom rolls. The rolls axially slide on the rods 124 and as will be noted, the top left roll is moved toward the center while the bottom left roll is moved toward the left side. The top right roll is moved to the right side and the bottom right roll is moved to the center and overlaps with the top left roll. Thus, membrane 116 is pulled off the upper left roll and bottom right roll while the other rolls are simply stored until needed.

Refer also to FIG. 4A which illustrates the leading end 126 of a roll of membrane folded and welded together at 128 to form a sleeve for receiving a rigid crossbar 130. Note that the leading edge 126 is notched at 132 to expose the rod 130 and thereby enable coupling of the pusher rods 118 to the crossbar 130. This can be seen in FIG. 5 which shows the bottom end of the pusher rod 118 formed into a hook shape 134 and coupled to crossbar 130 through the notch 132 in sleeve end 126.

Referring to FIG. 4, a hose reel 70 is mounted on the trailing end of trailer 52 and secondary mixer 78 and holding tank 74 on the leading end of trailer 52. Also shown in combination with the mixer 78 and holding tank 74 is a bladder 136 of foaming agent, e.g., Geofoam from Mearl Corp. It is in liquid form and has a relation in the cellular grout mix of about 500 parts cement to one part foaming agent. It is contemplated that a bladder 136 can be replaced as needed with replacement bladders although the provision of the foaming agent is not a major obstacle and can be supplied in various ways.

The hose reel 70 is rotatably mounted and is capable of holding as much as a mile of hose 68 through which grout is pumped. When the end of the hose is reached, the mobile mixing station 56 has to be moved along the road 54 and in the process, the hose 68 is rewound onto the reel 70. A swivel connection within reel end 138 directs grout from the hose 68 to the holding tank 74 through line 72 which extends down through the end brace 140 and along the bottom of the trailer to the front end thereof where it connects into the holding tank 74. A valve 142 controls filling of the secondary mixer 78 from the holding tank 74 and two progressive cavity pumps 144 pump the cellular grout from the mixer 78 through line 80 to the augers.

The mixer 78 includes a wave form blade 146 driven by hydraulic motor 148 and is designed to mix heavy materials like grout.

Figure 5A:
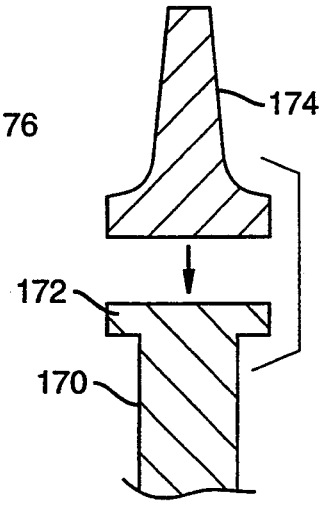
FIG. 5A illustrates a benefit of the invention.
Figure 6A:
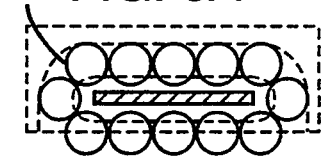
FIGS. 6 and 6A are enlarged views of the support structure for the apparatus of FIGS. 3 and 4.
Figure 5:
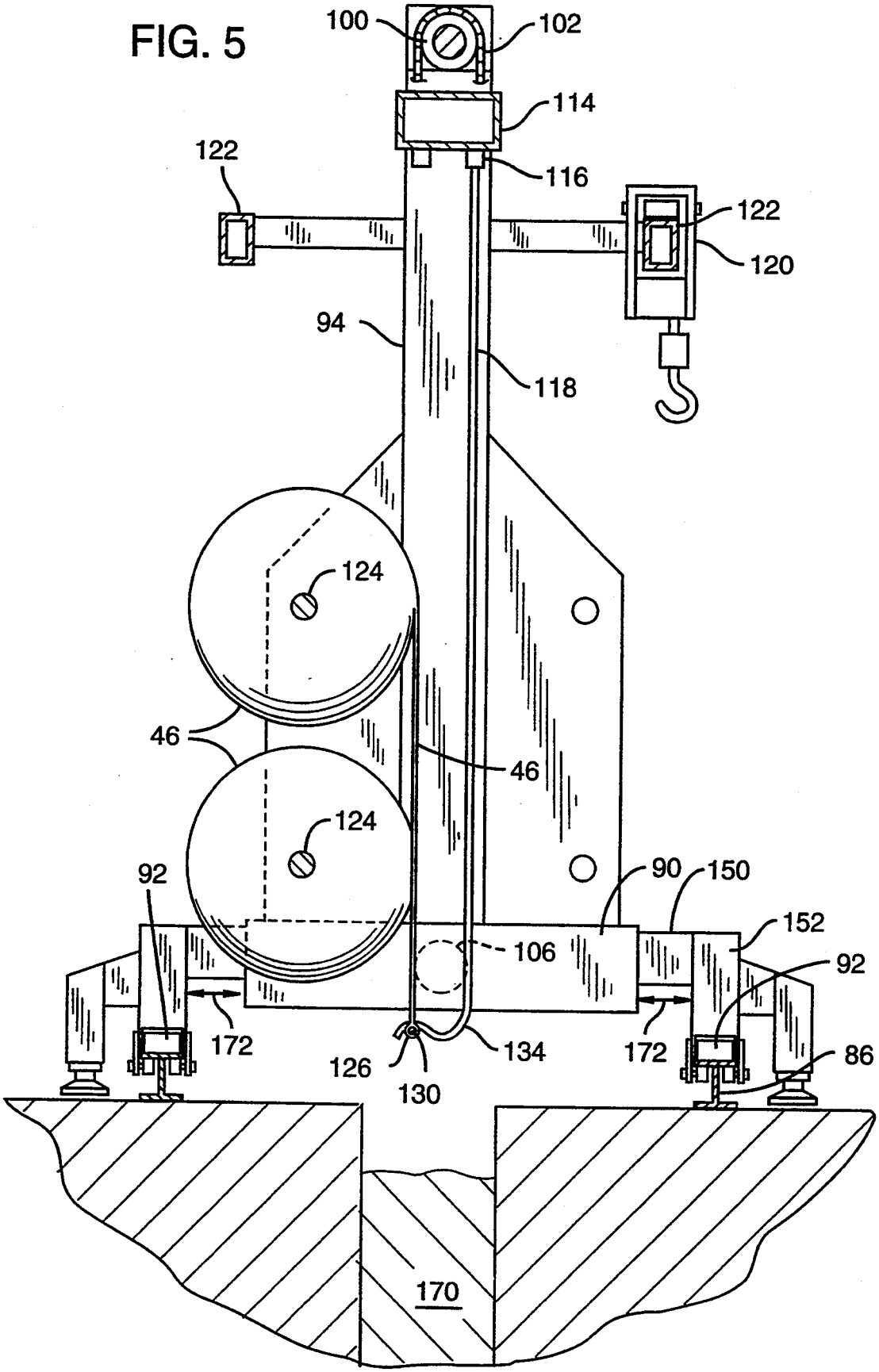
FIG. 5 is an end view of the apparatus as taken on view lines 5—5 of FIG. 4.
Figure 6:
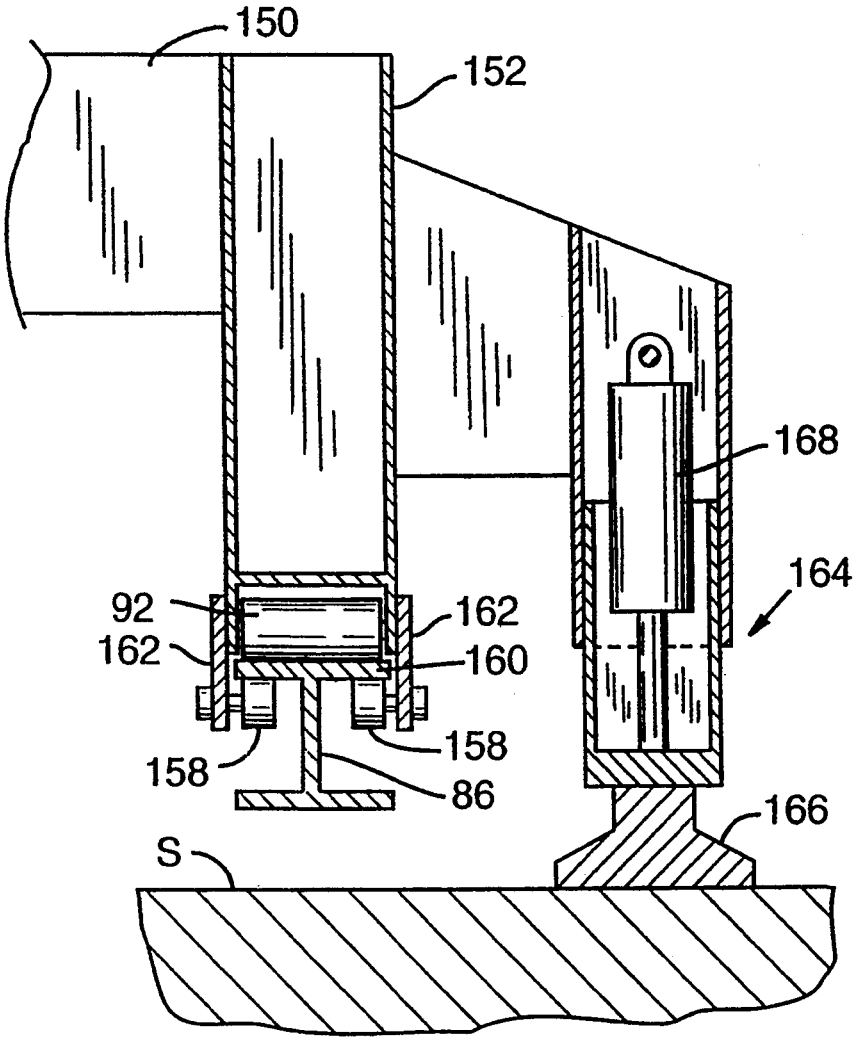

Reference is now made to FIGS. 5 and 6 to illustrate the manner by which the trailers 50, 52 are supported on the rails or track 86. As will be noted, the rails 86 are I beam shaped. The chassis 90 includes hydraulic rods 150 that are hydraulically extendable from the chassis 90. Provided on the ends of rods 150 are the supports 152. A roller assembly protrudes from the supports 152 and as particularly illustrated in FIG. 6, the roller assembly includes upper rollers 92 and bottom retention rollers 158. As illustrated, the rollers 92 support the weight of the trailer on the top flange 160 of the rail while the bottom rollers (and holders 162) entrap the rail and thus insure retention of the rollers 92 on the rails 86.

The supports 152 further include lifting jacks 164 having pads 166 adapted to be lowered by hydraulic cylinder 168. FIG. 5 shows the pads 166 in the raised position and FIG. 6 shows the pads 166 in the lowered position. As shown in FIG. 6, with the pads lowered, the weight of the trailer is shifted off the rails and onto the pads 166. Because the rails 86 are entrapped by bottom rollers 158, the rails are raised off the surface S of the levy. In this position, the portion of the rails under the trailer do not drag on the ground. This provides an easier pull of the rails when moved as the rails readily pull through the rollers 92, 158. FIG. 6A is a type of roller contemplated for the roller 92 and is referred to as a Hillman roller. It reduces the friction as between the rail and the support 152 and is considered to have a significant advantage over a wheel support directly engaging the ground.

The support 150, 152 for the chassis 90 as seen in FIG. 5 also has the advantage of laterally shifting the entire trailer relative to the rails. Thus, where the rails are laid down slightly off line with the intended alignment of the wall, the wall being indicated in FIG. 5 as 170, the rods 150 can be hydraulically shifted as indicated by arrows 172 to establish the desired alignment.

The top of the wall 170 may furthermore be formed as a flat raised shelf 172 as shown in FIG. 5A and provides the advantage of enabling rapid extension to the levy height in the form of concrete barriers 174 similar to that used for highway dividers. When laid end to end on the raised shelf 172 and sealed together, they can provide, e.g., a three foot height extension and replace the traditional method of sandbagging for gaining additional height in a flood situation.

The trailer mounted auger is believed to have a significant advantage for certain pipe placement applications as well. In sandy soil digging a trench is often very difficult as the sides of the trench cave in. Also, shallow water tables are prevalent in sandy soil and water will flow into the trenches. Whereas these problems have been solved in the main, the solutions are shoring of the walls and pumping out the water, both being expensive and sometimes difficult to accomplish.

The post inserting trailer can be used substantially as described to create two spaced apart walls down the length of a designated trench. These walls can be provided using the same procedure as described above. By strategically locating the rails 86, the chassis of the trailer can be shifted to one side for placement of one side wall of the trench and then shifted to the other side for placement of the other side wall. As necessary, a concrete floor may be placed between the two walls by forcing a concrete slurry out the bottom of the augers in the lower most position. Once the walls are formed, the earth material between the walls can be easily removed for placement of the pipe. The membrane inserting trailer may also be used, e.g., for placing rebar in the walls for added strength.

Figure 1C:
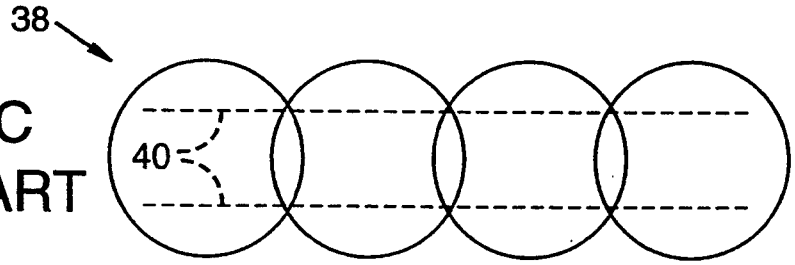
FIG. 1C PRIOR ART
Figure 1D:
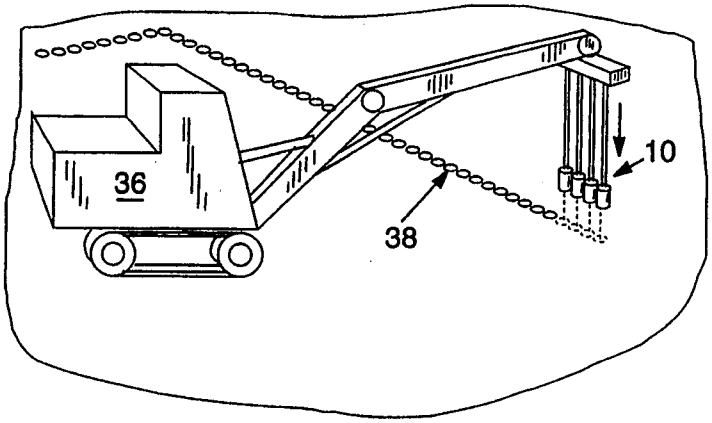
FIG. 1D Prior Art
Figure 2A:
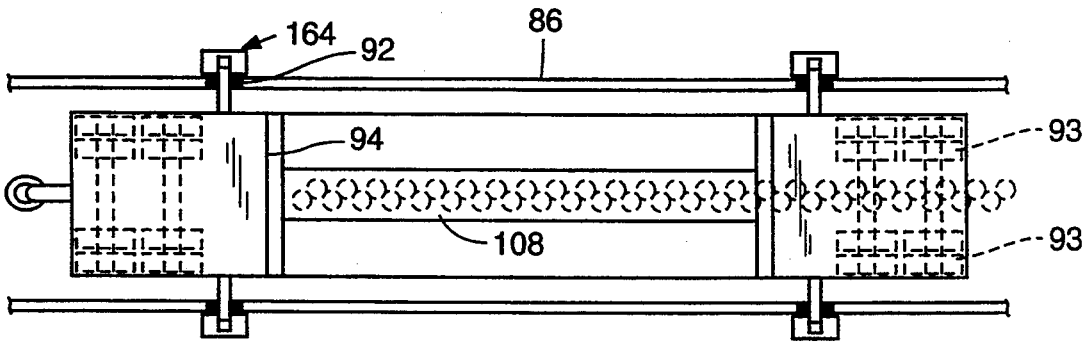
FIGS. 2A and 2B illustrate a soil-concrete wall being formed by the process of FIG. 2.
Figure 2B:
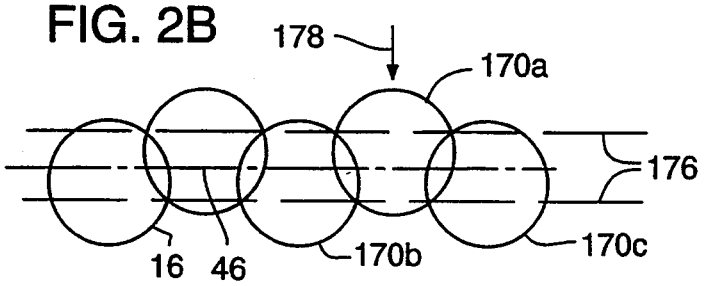

FIG. 2A is a schematic plan view of the post inserting trailer with the auger assembly removed to illustrate the pattern of posts that are formed by the disclosed process and apparatus. FIG. 2B is an enlargement of the post pattern. As will be noted, the posts as installed are staggered and create a continuous wall thickness indicated by the dash lines 176. The staggered pattern offers increased strength to counter a side force as indicated by arrows 178. As compared to FIG. 1C, the staggered posts will resist much greater side force 178. A post 170*a* being subjected to a force 178 is buttressed by the combined support of posts 170*b* and 170*c*.

The embodiments as described are subject to numerous variations without departing from the intended scope of the invention which is established by the claimed appended hereto.

I claim:

1. An apparatus for installing a concrete barrier underground comprising;

a mobile chassis movable in a forward direction on the ground surface over an underground area wherein a barrier is to be installed, said forward direction of the chassis defining a front end and a rear end of the chassis;

a front end vertical mast and a rear end vertical mast mounted on the chassis, and a horizontal carrier bar mounted between and having vertical sliding movement relative to said masts;

a plurality of augers rotatably mounted to said carrier bar, and controls controlling the sliding movement of the carrier bar and the rotating movement of said augers for driving said rotating augers into the surface and forming holes of loosened soil in said underground area, said augers arranged along said carrier bar and between said masts whereby said holes are arranged in overlapping relation extended along the length of the chassis;

said augers each having a shaft and an auger head and a core opening through the shaft extended to an outlet at the auger head;

a source of grout connected to said core opening for pumping grout slurry into the loosened soil through the rotating auger head as the bar is raised and thereby mixing the grout with the soil and producing soil-concrete posts throughout the depth of the holes, the arrangement of holes and concrete posts produced therein providing a barrier wall segment; and power means for moving the chassis the length of the wall segment for drilling and installing a further contiguous wall segment.

2. An apparatus as defined in claim 1 including a water source connected to the core opening of said augers while drilling the holes to saturate the loosened soil and the wall surrounding the holes.

3. An apparatus as defined in claim 1 wherein said augers are arranged in a staggered pattern for installing soil-concrete posts overlapping and staggered in arrangement to enhance the strength of the barrier wall in opposing lateral forces.

4. An apparatus as defined in claim 1 wherein a foaming agent is added to the grout, and including the insertion into the uncured slurry of soil-concrete a water impervious membrane to prevent moisture from penetrating through the barrier.

5. An apparatus as defined in claim 1 wherein the chassis includes wheels adapted for traveling on rails, and parallel rails laid on the surface, and said wheels supported on the rails whereby the weight of the chassis is spread lengthwise along the rails and the underlying surface, and further to thereby minimize resistance to moving of the chassis along the surface for installing subsequent barrier wall segments.

6. An apparatus as defined in claim 1 for installing a barrier along the length of a levee, said mobile chassis being a first mobile chassis and including a second mobile chassis that follows the first mobile chassis;

a sheet of water impervious membrane and an inserting mechanism carried by said second mobile chassis for sequentially inserting the membrane into the uncured slurry of previously installed wall segments produced by said first chassis.

7. An apparatus as defined in claim 6 wherein the membrane is a flexible material carried on the second chassis in a roll, a leading edge of the membrane unrolled from the roll and formed into a sleeve, and a rigid crossbar inserted into the sleeve to provide a rigid leading edge for insertion into the slurry;

said inserting mechanism including a plurality of rigid vertically oriented rods and a drive mechanism for driving the rods into the slurry, said rods having a leading end configured to connect to the crossbar for driving the rigid leading edge of the membrane into the slurry.

8. An apparatus as defined in claim 7 wherein said second chassis includes a front mast and a rear mast and wherein said driving mechanism comprises a carrier bar slidably mounted to the masts, connectors on said carrier bar for receiving a trailing end of said rods and a control for driving the bar vertically downward and thereby the rods and leading edge of the membrane into the soil-concrete slurry.

9. An apparatus as defined in claim 5 for installing a barrier along the length of a levee, said chassis being a first mobile chassis and including a second mobile chassis that follows the first mobile chassis;

a roll of water impervious membrane and an inserting mechanism carried by said second mobile chassis for inserting the membrane into the uncured slurry of soil-concrete, said second chassis also mounted on the rails;

said rails having a length substantially longer than the combined length of the two chassis for sequential movement of the two chassis and the installation of multiple soil-concrete barrier segments, said rails having a length substantially less than the length of the levee whereby movement of the rails is required; and said chassis having an undercarriage and said wheels mounted to said undercarriage, and lifting jacks provided on said undercarriage adjacent said wheels and laterally of said rails, and said lifting jacks adapted to engage the surface to lift the undercarriage and chassis and thereby the wheels off the rails to permit lengthwise movement of the rails.

10. A system for inserting a barrier wall in an earth levee comprising;

rails laid along the length of the levee;

a post inserting trailer and a membrane inserting trailer, said trailers including undercarriages including rail riding wheels that are supported on said rails and a grout mixing plant located proximate to the levee;

said post inserting trailer including multiple hole drilling, grout inserting augers arranged in overlapping relation and extended along a length of the levee wherein a section of a barrier wall is to be inserted;

said membrane inserting trailer including a supply of water impervious membrane sheet material, and mechanism for inserting the membrane sheet material into a barrier wall of uncured soil-concrete;

said grout mixing plant including a mixer for mixing cement-water grout in slurry form, and a conveyor for conveying the grout to the augers of the post inserting trailer to be mixed with soil loosened by said augers; and power means for moving the trailers in wall segment increments to sequentially, first with said augers, drill overlapping holes along a barrier wall segment to provide loosened soil in said holes, and insert and mix the grout with the loosened soil to provide a slurry of soil-concrete in said holes, then with said membrane inserting mechanism, inserting a length of membrane into the uncured slurry of said soil-concrete.

11. A system as defined in claim 10 wherein a foaming agent is mixed with said grout to expand the volume of the grout and produce a less dense slurry.

12. A system as defined in claim 10 whereby laterally extendable hydraulic cylinders connect said rail-riding wheels to said trailers whereby the trailers can be shifted laterally relative to the rails through actuation of the cylinders.

13. A system as defined in claim 10 including lifting jacks carried by said trailers, said lifting jacks engageable with the levee surface to lift the trailers off the rails.

* * * * *